US006878070B1

(12) United States Patent
Wilk

(10) Patent No.: US 6,878,070 B1
(45) Date of Patent: Apr. 12, 2005

(54) NOVELTY OR ENTERTAINMENT DEVICE AND ASSOCIATED METHOD

(76) Inventor: Peter J. Wilk, 185 W. End Ave., New York, NY (US) 10023

( * ) Notice: Subject to any disclaimer, the term of this patent is extended or adjusted under 35 U.S.C. 154(b) by 761 days.

(21) Appl. No.: 09/661,520

(22) Filed: Sep. 13, 2000

(51) Int. Cl.[7] ..... A63J 23/00
(52) U.S. Cl. ..... 472/56; 446/397; 446/175
(58) Field of Search ..... 472/51–56; 446/297, 446/175, 302, 299, 354

(56) References Cited

U.S. PATENT DOCUMENTS 1,795,213 A * 3/1931 Jordahn ..... 446/81
4,314,423 A * 2/1982 Lipsitz et al. ..... 446/303
4,687,457 A * 8/1987 Milner ..... 446/175
4,819,616 A * 4/1989 Samson ..... 600/28
4,923,428 A * 5/1990 Curran ..... 446/175
4,934,079 A * 6/1990 Hoshi ..... 40/427
5,316,516 A * 5/1994 Saitoh ..... 446/175
6,024,625 A * 2/2000 Pearce ..... 446/81
6,150,947 A * 11/2000 Shima ..... 340/692

* cited by examiner

*Primary Examiner*—K. T. Nguyen
(74) *Attorney, Agent, or Firm*—R. Neil Sudol; Henry D. Coleman; Wiliam J. Sapone

(57) ABSTRACT

A novelty or entertainment device includes a housing in the form of a sea shell. A sound reproduction system is mounted to the housing so as to remain hidden from casual visual inspection thereof. A switch is mounted to the housing and is operatively connected to the sound reproduction system for activating same in response to a lifting of the housing to an ear of a user.

18 Claims, 1 Drawing Sheet

NOVELTY OR ENTERTAINMENT DEVICE AND ASSOCIATED METHOD

BACKGROUND OF THE INVENTION

This invention relates to a novelty device. This invention also relates to an associated method.

The entertainment industry is always in search of products which provide a surprise to the user. Surprise is the essense of entertainment. One kind of surprise arises when everyday articles exhibit an unexpected characteristic or behave in a way which is contrary to their everyday function.

One particularly valued form of entertainment is humor. Juxtaposing things, thoughts, perceptions, sensations which do not naturally occur together in the natural order of things frequently results in humorous entertainment.

OBJECTS OF THE INVENTION

It is an object of the present invention to provide a novelty item.

Another object of the present invention is to provide such an item which provides a humorous entertainment adapted to different circumstances.

An additional object of the present invention is to provide a novelty item which appears to be a naturally occurring object but which, on closer inspection, provides an unnatural sensory input to the user.

These and other objects of the present invention will be apparent from the drawings and descriptions herein. It is believed that each embodiment of the invention attains one or more of the objects set forth herein.

SUMMARY OF THE INVENTION

A novelty or entertainment device comprises, in accordance with the present invention, a housing in the form of a sea shell, a sound reproduction system mounted to the housing so as to remain hidden from casual visual inspection of the housing, and a switch mounted to the housing and operatively connected to the sound reproduction system for activating same in response to a lifting of the housing to an ear of a user.

The sea shell may be a naturally occurring shell, such as a conch shell. Alternatively, the sea shell may be a manufactured replica of a sea shell. In that case, the artificial shell is preferably appears sufficiently authentic to entice a person to lift the shell to his or her ear in order to listen for the sound of surf.

It is contemplated that the sound reproduction system includes a memory for storing at least one sound or series of sounds readily comprehensible as something other than the expected ocean sounds. The artificial sound or sounds generated by the sound reproduction system upon a lifting of the shell to the ear may be a simulation of a natural sound such as the roar of a lion, the song of a bird, the croaking of a frog, the buzzing of a bee, the rustle of leaves blowing in the wind, etc. Preferably, however, the sound is a recorded spoken message, such as "Did you hear the one about . . . ," "Friends, Romans, countrymen, lend me your ear," "This is going to cost you," "Get your ear out of my house," "Hey, you, mind your own business," "I bet you're a Peeping Tom, too," "Our next tune is one that all of you love," "Which number are you calling, please?" "I'll bet you're all ears," etc. Alternatively or additionally, the prerecorded sound stored in the memory of the sound reproduction system may be a musical selection or a machine sound such as the dial tone of a telephone, the roar of a motorcycle or lawn mower, the whistle of a train, the tolling of a bell, etc.

The memory of the sound reproduction system in a novelty item in accordance with the present invention may store several different sound sequences which are reproduced in a predetermined or random sequence. Accordingly, successive placements of the shell to the ear of a user will result in the reproduction of different sounds. The sound sequences may be different examples of the same kind of sound, for example, a series of different jokes, different natural sounds, or different machine sounds. Alternatively, the multiple sound sequences in a memory may be of different kinds, so that a first sound is a natural sound, a second sound a machine sound, a third sound a musical passage, a fourth sound a voice message, etc.

The memory of the sound reproduction system may include a removable cartridge, enabling an exchange of the memory so that a new sound or series of sounds may be produced on subsequent placements of the sea shell next to a user's ear. Replaceable memory cartridges may have respective seasonal themes. For example, a Halloween cartridge might reproduce sounds such as a witch's cackle, a hyena's laugh, an owl's screech, a ghost's moan, a squeaking door hinge, etc. An Independence Day cartridge might reproduce patriotic sounds such as a national anthem, fireworks, historical speeches, etc. Alternatively, different cartridges might correspond to a location in which the shell is to be found. For instance, a shell in a retail establishment might announce sales specials, while a shell in a museum might present facts of interest to the museum visitor.

The switch activating the shell's sound reproduction system may be a gravity switch. In that case, a delay may be included in a circuit of the sound reproduction system so that the recorded sound is generated only after sufficient time has elapsed for the shell to be placed next to the ear of the user after having been lifted from rest on a table or desk.

Other kinds of switches or activation mechanisms may be used in place of a gravity switch and a delay. For example, the switch or activation mechanism may be connected to a proximity detector which functions to sense nearness of a surface such as a person's head to a mouth or opening of the shell-shaped housing. A suitable proximity detector includes a piezoelectric crystal, an ultrasonic waveform generator connected thereto, a power source (battery), a piezoelectric sensor monitoring incoming ultrasonic pressure waves, and a logic unit (with timer) connected to the sensor and to the generator or piezoelectric crystal for monitoring returning signals in response to an ultrasonic wave packet or pulse produced by the crystal.

An ideal shell shape for the housing of the instant novelty item is a conch shell.

The sound reproduction system may include a solid-state memory, a power source, and an electroacoustic transducer.

An associated novelty or entertainment method comprises, in accordance with the present invention, providing a housing in the form of a sea shell, and, in response to a removal of the housing from a stationary storage position towards an ear of a user, reproducing a predetermined sound so that the reproduced sound may be perceived by the user. As discussed above, the stored sound may include a verbal message. In one embodiment of the invention, the sound is automatically reproduced upon an automatic sensing of a movement of the housing.

DETAILED DESCRIPTION

Figure 1:
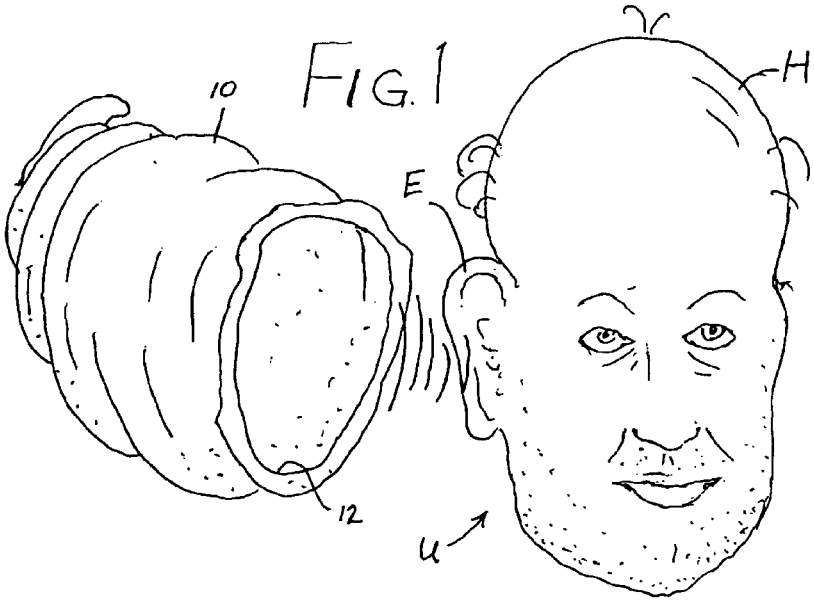
FIG. 1 is a schematic perspective view of a novelty item in accordance with the present invention, in use.

As illustrated in FIG. 1, a novelty or entertainment device comprises a housing 10 in the form of a sea shell particularly a conch shell. According to pervasive lore, placing a conch shell so that a mouth opening 12 thereof is justaposed to an ear E of a user U results in the user having an aural sensation akin to the sound heard at the sea shore or on the open seas. Consequently, it is not uncommon for a user U, upon espying a conch shell, to casually lift the conch shell to his or her ear E. The novelty item disclosed herein recognizes that impulse and capitalizes on it to provide a surprising sound to the user U upon the placement of shell 12 next to the user's ear E.

Figure 2:
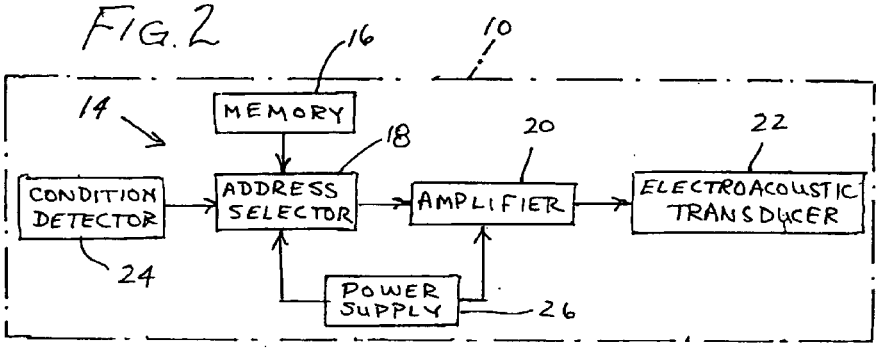
FIG. 2 is a block diagram of functional components of the novelty item depicted in FIG. 1.

As illustrated in FIG. 2, a sound reproduction system 14 is mounted to housing or shell 10 so as to remain hidden from casual visual inspection of the housing. Sound reproduction system 14 includes a solid-state memory 16 for storing at least one sound or at least one series of sounds readily comprensible as something other than the expected ocean sounds. Memory 16 is accessed by an address selector 18 which reads the contents of a location or area of memory 16 and transfers the sound-encoding electrical signals to an amplifier 20. Address selector 18 or amplifier 20 may be provided with a digital-to-analog converter (not shown) which transforms digital signals from memory 16 into an analog signal. The amplitude of the analog signal is increased by amplifier 20 and fed to an electroacoustic transducer or speaker 22 which produces aurally detectible acoustic pressure waves detectible in part by the user U through the well-known functional components of the ear E.

Address selector 18 is connected at an input to a condition detector 24 which functions in part as a switch to activate the address selector. Various components of sound reproduction system 14, including address selector 18 and amplifier 20, are connected to a power supply 26 such as a battery. Again, all of the components of sound reproduction system 14 are mounted to and hidden inside shell 10.

Figure 3:
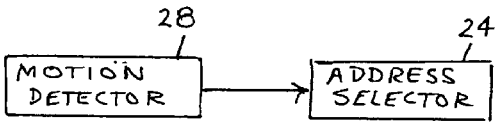
FIG. 3 is a block diagram illustrating a modification or variation of the assembly of functional components shown in FIG. 2.

Condition detector or switch 24 may be a gravity switch or motion detector 28 (FIG. 3) which detects the condition of acceleration. Thus, when shell or housing 10 is lifted from a rest position, condition detector or switch 24 transmits an activation signal to address selector 18 to induce the production of a sound. In that case, a delay circuit (not shown) may be included in gravity switch or motion detector 28 or address selector 18 so that the recorded sound is generated only after sufficient time has elapsed for the shell 10 to be placed next to the ear E of the user U.

Figure 4:
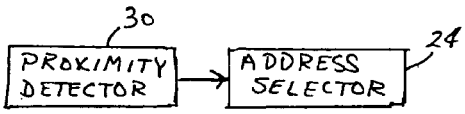
FIG. 4 is a block diagram illustrating another modification or variation of the assembly of functional components shown in FIG. 2.

In an alternative form, condition detector or switch 24 incorporates a proximity detector 30 (FIG. 4) for sensing nearness of a surface such as the head H of user U to mouth opening 12 of the shell-shaped housing 10. Proximity detector 30 may be of the ultrasonic type and include a piezoelectric crystal, either a dedicated element (not shown) or transducer 22. The proximity detector may further include an ultrasonic waveform generator connected to the piezoelectric crystal. The function of this ultrasonic waveform generator may be performed by memory 16, address selector 18, and amplifier 20. Alternatively, a dedicated unit (not illustrated) may be provided. The proximity sensor additionally includes an acoustoelectric sensor (such as transducer 22), which is capable of monitoring incoming ultrasonic pressure waves, and a logic unit (with timer) connected to the sensor and to the generator or piezoelectric crystal for monitoring returning signals in response to an ultrasonic wave packet or pulse produced by the crystal.

Figure 5:
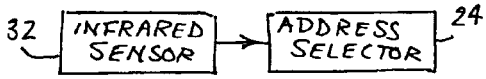
FIG. 5 is a block diagram illustrating yet a further modification or variation of the assembly of functional components shown in FIG. 2.

As another alternative, condition sensor or switch 24 may incorporate an infrared sensor 32 (FIG. 5) for detecting the temperature of a body placed next to mouth opening 12.

The artificial sound or sounds stored in digitally encoded form in memory 16 and generated by sound reproduction system 14 upon a lifting of the shell to the ear may be a simulation of a natural sound such as the roar of a lion, the song of a bird, the croaking of a frog, the buzzing of a bee, the rustle of leaves blowing in the wind, etc. Preferably, however, the sound is a recorded spoken message, such as "Did you hear the one about . . . ," "Friends, Romans, countrymen, lend me your ear," "This is going to cost you," "Get your ear out of my house," "Hey, you, mind your own business," "I bet you're a Peeping Tom, too," "Our next tune is one that all of you love," "Which number are you calling, please?" etc. Alternatively or additionally, the prerecorded sound stored in memory 16 of sound reproduction system 14 may be a musical selection or a machine sound such as the dial tone of a telephone, the roar of a motorcycle or lawn mower, the whistle of a train, the tolling of a bell, etc.

Memory 16 may store several encoded signals corresponding to respective sounds. The encoded sounds are accessed by address selector 18 in a predetermined sequence or, alternatively, a random sequence. In this way, consecutively positioning shell 10 at the ear E of user U will result in the hearing of different sounds by user U. The sound sequences may be different examples of the same kind of sound, for example, a series of different jokes, different natural sounds, or different machine sounds. Alternatively, the multiple sound sequences in memory 16 may be of different kinds, so that a first sound is a natural sound, a second sound a machine sound, a third sound a musical passage, a fourth sound a voice message, etc.

Memory 16 may be implemented in part as a removable cartridge, enabling an exchange of memory 16 so that a new sound or series of sounds may be produced on subsequent placements of the sea shell next to a user's ear. Replaceable memory cartridges may have respective seasonal themes. For example, a Halloween cartridge might reproduce sounds such as a witch's cackle, a hyena's laugh, an owl's screech, a ghost's moan, a squeaking door hinge, etc. An Independence Day cartridge might reproduce patriotic sounds such as a national anthem, fireworks, historical speeches, etc. Alternatively, different cartridges might correspond to a location in which the shell is to be found. For instance, a shell in a retail establishment might announce sales specials, while a shell in a museum might present facts of interest to the museum visitor.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A novelty or entertainment device comprising:

a housing in the form of a sea shell;

a sound reproduction system mounted to said housing so as to remain hidden from casual visual inspection of said housing; and a switch mounted to said housing and operatively connected to said sound reproduction system for activating same after and only after a lifting of said housing.

2. The device defined in claim 1 wherein said switch is a gravity switch.

3. The device defined in claim 1 wherein said switch is connected to a proximity detector for sensing nearness of a surface to a mouth of said housing.

4. The device defined in claim 1 wherein said sea shell is in the form of a conch shell.

5. The device defined in claim 1 wherein said sound reproduction system includes a solid-state memory, a power source, and an electroacoustic transducer.

6. The device defined in claim 1 wherein said sound reproduction system includes a memory storing a plurality of different sound bites and means for accessing different ones of said sound bites on successive activations of said sound reproduction system by said switch.

7. A novelty or entertainment method comprising:

providing a housing in the form of a sea shell; and in response to a removal of said housing from a stationary storage position towards an ear of a user, reproducing a predetermined sound so that the reproduced sound may be perceived by the user upon and only upon an approximation of a mouth of said housing to the ear of the user.

8. The method defined in claim 7 wherein the sound includes a verbal message.

9. The method defined in claim 7, further comprising automatically sensing a movement of said housing, the reproducing of said sound being induced upon the sensing of said movement.

10. A novelty or entertainment device comprising:

a housing in the form of a sea shell;

a sound reproduction system mounted to said housing so as to remain hidden from casual visual inspection of said housing; and a switch mounted to said housing and operatively connected to said sound reproduction system for activating same in response to a lifting of said housing, said switch including means for selectively activating said sound reproduction system only after said housing has been placed proximate to a surface.

11. The device defined in claim 10 wherein said switch includes a gravity switch.

12. The device defined in claim 10 wherein said switch is connected to a proximity detector for sensing nearness of said surface to a mouth of said housing.

13. A novelty or entertainment device comprising:

a housing in the form of a sea shell;

a sound reproduction system mounted to said housing so as to remain hidden from casual visual inspection of said housing; and a switch mounted to said housing and operatively connected to said sound reproduction system for activating same in response to a lifting of said housing, said sound reproduction system including a memory storing a plurality of different sound bites and means for accessing different ones of said sound bites on successive activations of said sound reproduction system by said switch.

14. A novelty or entertainment method comprising:

providing a housing in the form of a sea shell; and after and only after a removal of said housing from a stationary storage position, reproducing a predetermined sound so that the reproduced sound may be perceived by the user.

15. The method defined in claim 14 wherein the sound includes a verbal message.

16. The method defined in claim 14, further comprising automatically sensing a movement of said housing, the reproducing of said sound being induced upon the sensing of said movement.

17. A novelty or entertainment method comprising:

providing a housing in the form of a sea shell;

in response to a first removal of said housing from a stationary storage position, reproducing a first predetermined sound so that the reproduced sound may be perceived by the user; and in response to a second removal of said housing from a stationary storage position, reproducing a second predetermined sound so that the reproduced second predetermined sound may be perceived by the user, said second predetermined sound being substantially different from said first predetermined sound.

18. A novelty or entertainment device comprising:

a housing in the form of a sea shell;

a sound reproduction system mounted to said housing so as to remain hidden from casual visual inspection of said housing, said sound reproduction system including a memory storing a signal corresponding to a predetermined sound substantially different from sound generated in nature upon placement of a sea shell next to an ear; and a switch mounted to said housing and operatively connected to said sound reproduction system for activating same in response, at least in part, to a lifting of said housing.

* * * * *